US005363674A

United States Patent [19]

Powell, deceased

[11] Patent Number: 5,363,674

[45] Date of Patent: Nov. 15, 1994

[54] ZERO SUPERHEAT REFRIGERATION COMPRESSION SYSTEM

[75] Inventor: James W. Powell, deceased, late of Guilford, Conn., by Barbara G. Powell, Executrix

[73] Assignee: Ecoair Corp., New Haven, Conn.

[21] Appl. No.: 58,392

[22] Filed: May 4, 1993

[51] Int. Cl.[5] ..... F25B 31/00; F25B 1/00; F25B 43/00; F04B 17/00

[52] U.S. Cl. ..... 62/505; 62/83; 62/498; 62/510; 417/366; 417/371; 417/423.8

[58] Field of Search ..... 62/83, 505, 510, 498; 417/366, 371, 423.8

[56] References Cited

U.S. PATENT DOCUMENTS

| | | | |
|---|---|---|---|
| 2,458,730 | 1/1949 | Ponomareff | 230/117 |
| 2,793,506 | 5/1957 | Moody | 62/117.6 |
| 2,888,193 | 5/1959 | Greenwald | 417/423.8 X |
| 3,106,334 | 10/1963 | Fogleman et al. | 62/505 X |
| 3,171,589 | 3/1965 | Cramer et al. | 230/206 |
| 3,388,559 | 6/1968 | Johnson | 62/505 X |
| 3,479,837 | 11/1969 | Miner | 62/505 X |
| 3,825,366 | 7/1974 | Herrick | 415/131 |
| 3,859,815 | 1/1975 | Kasahara | 62/197 |
| 3,894,815 | 7/1975 | Beeton | 62/505 X |
| 4,105,372 | 8/1978 | Mishina et al. | 417/243 |
| 4,182,137 | 1/1980 | Erth | 62/505 |
| 4,537,046 | 8/1985 | Fujiyama et al. | 62/505 |
| 4,899,555 | 2/1990 | Shaw | 62/505 |
| 4,938,661 | 7/1990 | Kobayashi et al. | 415/199 |

FOREIGN PATENT DOCUMENTS

| | | | |
|---|---|---|---|
| 1914798 | 9/1970 | Germany | 417/423.8 |
| 55-98692A | 7/1980 | Japan . | |
| 4112990 | 4/1992 | Japan | 417/371 |
| 208660 | 11/1968 | Sweden . | |
| 69291 | 1/1952 | Switzerland . | |
| 381561 | 10/1932 | United Kingdom | 417/371 |

*Primary Examiner*—Henry A. Bennett
*Assistant Examiner*—Christopher Kilner
*Attorney, Agent, or Firm*—DeLio & Peterson

[57] ABSTRACT

A multistage centrifugal compressor, comprising a casing having an inlet portion and a compression portion. The inlet portion has an inlet opening gaseously coupled to an evaporator so as to receive a gaseous refrigerant. The inlet and compression portions each have a plurality of gas passages therethrough. The compression portion has an outlet opening that is located at the end of the casing which is opposite the end of the casing having the inlet opening. An electric motor assembly is positioned within the inlet portion of the casing so as to provide a transfer of heat dissipated by the motor assembly to the gaseous refrigerant entering through the inlet opening. The gaseous refrigerant flowing in the inlet opening passes through and about the motor assembly so as to cool the motor assembly. The gaseous refrigerant is heated by the heat dissipated by the motor assembly so as to evaporate any liquid molecules within the gaseous refrigerant thereby permitting the evaporator to operate at a zero superheat level. A shaft is disposed within and is coaxial with the axis of the casing. The shaft is rotatably engaged with the motor assembly. A first rotor is disposed within the compression portion and attached to the shaft so as to provide a first centrifugal compression stage. The first compression stage is gaseously coupled to the gas passages of the inlet portion. A second rotor is disposed within the compression portion and attached to the shaft so as to provide a second centrifugal compression stage. The second centrifugal compression stage is gaseously coupled to first centrifugal compression stage. The second centrifugal stage is intermediate the first compression stage and the outlet opening. The second centrifugal compression stage being gaseously coupled to said outlet opening.

29 Claims, 4 Drawing Sheets

ZERO SUPERHEAT REFRIGERATION COMPRESSION SYSTEM

BACKGROUND OF THE INVENTION

1. Field of the Invention

This invention relates generally to air conditioning compressor systems and more particularly, to multi-stage centrifugal compressors designed to operate with a gaseous refrigerant entering at a nominal zero superheat level.

2. Description of Related Art

Presently, there is a need for small sized centrifugal compressors which are efficient and capable of being integrated in all types of systems, most typically, automotive systems. To make such small centrifugal compressors practical, it is necessary to use refrigerants which have lower vapor pressures and higher specific volumes than are encountered in conventional refrigerant systems, which typically employ piston, vane or scroll compressors. Furthermore, recent international legislation engendered by environmental concerns over the issues of global warming and ozone depletion have mandated the elimination of freons including those used in the multi-billion dollar air conditioning/refrigeration industry. Substitute refrigerants that have more beneficial environmental indices, such as R134 (a replacement for R12 which is widely used in the automotive industry) have been proposed for use in conventional air conditioning/refrigeration systems. Recently developed refrigerants, such as R134, have much higher specific volumes than conventional R12 and R22 fluids. Use of such recently developed refrigerants, however, requires a higher operating pressure ratio across the compressor which cannot be readily achieved with a single centrifugal compressor stage. Typically, conventional compressor systems utilize two (2) centrifugal stages and an electric motor intermediate the two (2) stages. Such systems are disclosed in U.S. Pat. Nos.: 2,793,506 , 3,859,815 and 4,105,372. The refrigerant enters the first, or low pressure, compression stage where it is partially compressed. The partially compressed gaseous refrigerant then passes through a diffuser and is collected in a scroll. The gaseous refrigerant then is transferred via an external tube to the inlet of the second, or high pressure, compression stage, where the compression is completed. There are significant deficiencies in these systems. It has been found that significant aerodynamic losses are incurred in the collection of the gaseous refrigerant in the scroll and the transfer of the gaseous refrigerant through the outlet of the low compression stage and into the inlet of the high compression stage. These aerodynamic losses are manifested through degradation of the coefficient of performance (COP) of the refrigerant cycle.

Additionally, in conventional systems, the motor assembly is typically cooled by extracting a small amount of liquid refrigerant from the condenser and flashing it in passages in the motor assembly. The vaporization of the refrigerant supplies the requisite cooling. However, it has been found that degradation of the COP of the refrigerant cycle occurs when the gaseous refrigerant is returned to the main flow of the gaseous refrigerant at an intermediate station in the compressor. Alternatively, the gaseous refrigerant can be injected back into the suction line which couples the evaporator outlet and the compressor input. Superficially, this would appear to augment necessary superheat in the cycle and thus, not cause degradation in the refrigerant cycle. However, it has been found that since the compressor inlet in this type of cycle is sub-atmospheric, the suction line between the evaporator and the compression inlet must be very short to avoid excessive inlet pressure losses. Consequently, the evaporator and the compressor must be closely coupled, thereby making it very difficult to inject this waste refrigerant into the system at this point without incurring additional losses due to the compressor inlet distortion.

Conventional centrifugal compressors typically utilize D.C. (direct current) or low frequency A.C. (alternating current) electric motors. However, it has been found that vehicle performance is adversely affected by the heavy weight and voluminous size of these motors.

It has also been found that the utilization of transfer tubes to execute the transition of the refrigerant from the low pressure compression stage to the high pressure compressor stage imposes significant restrictions with respect to the design geometry of the compressor system and its integration with other systems, such as automobile engines. Such restrictions are contrary to automobile industry design criteria which specifies that primary air conditioning components be on or substantially adjacent the vehicle center line. Hence, compressor systems having a left side/right side drive capability would be preferred over systems having design geometry of the conventional systems. It is possible to design a substantially cylindrical configuration for the systems disclosed in the above mentioned U.S. Patents, however, the diameter of the compressor would significantly increase. Additionally, it has been found that the relatively large wetted surface area in such a configuration would contribute to unacceptable high pressure losses and thus, cause a deleterious impact on the refrigerant cycle.

Finally, it has been found that conventional compressors may allow gaseous refrigerant containing liquid to enter the compression stages. In conventional systems, the only remedy for this is to operate the evaporator at a level significantly above zero superheat level. However, this degrades the overall system performance because it is an energy-inefficient remedy.

Bearing in mind the problems of the prior art, it is therefore an object of the present invention to provide a new and improved centrifugal compressor having two (2) sequentially arranged centrifugal compression stages.

It is another object of the present invention to provide a new and improved centrifugal compressor that is smaller in size than conventional compressors.

It is a further object of the present invention to provide a new and improved centrifugal compressor wherein the electrical motor assembly is cooled by gaseous refrigerant directly emitted by an evaporator.

It is another object of the present invention to provide a new and improved centrifugal compressor wherein the processes of convection and conduction are utilized to heat the incoming gaseous refrigerant so as to remove any liquid therefrom, thereby permitting the evaporator to operate at a zero superheat level.

It is another object of the present invention to provide a new and improved centrifugal compressor wherein the geometric shape of the compressor allows it to be integrated into an automobile engine system at a point on or substantially adjacent the vehicle center line.

SUMMARY OF THE INVENTION

The above and other objects, which will be apparent to those skilled in the art, are achieved in the present invention which is directed to a method of operating a refrigeration system, comprising the steps of:

(a) providing an evaporator from which a refrigerant flows at a nominal zero superheat level;

(b) providing a centrifugal compressor, the compressor comprising a gas tight casing having an inlet portion and a compression portion, the inlet portion having an inlet opening gaseously coupled to the evaporator so as to receive a gaseous refrigerant, the inlet and compression portions each having a plurality of gas passages therethrough, the compression portion having an outlet opening that is located at the end of the casing which is opposite the end of the casing having the inlet opening, an electric motor assembly positioned within the inlet portion of the casing, a shaft disposed within and coaxial with the axis of the casing, the shaft being rotatably engaged with the motor assembly, at least one (1) centrifugal compression stage gaseously coupled to the inlet portion and to the outlet opening, the compression stage being drivingly engaged with the shaft and intermediate the inlet portion and the outlet opening;

(c) flowing the refrigerant gas into the inlet portion and around the motor assembly;

(d) transferring the heat dissipated by the motor assembly to the gaseous refrigerant flowing in the inlet portion so as to cool the motor assembly, evaporate any liquid in the gaseous refrigerant thereby permitting the evaporator to operate at a zero superheat level, and prevent gaseous refrigerant containing any liquid from entering the compression stage;

(e) suctionally inducing the gaseous refrigerant from the inlet portion into the centrifugal compressor stage;

(f) centrifugally compressing the gaseous refrigerant within the compression stage; and (g) exducing the compressed gaseous refrigerant from the compression stage into the outlet passage.

In a related aspect, the present invention is direct to a method of operating a refrigeration system, comprising the steps of:

(a) providing an evaporator from which a refrigerant flows at a nominal zero superheat level;

(b) providing a centrifugal compressor, the compressor comprising a gas tight casing having an inlet portion and a compression portion, the inlet portion having an inlet opening gaseously coupled to an evaporator so as to receive a gaseous refrigerant, the inlet and compression portions each having a plurality of gas passages therethrough, the compression portion having an outlet opening that is located at the end of the casing which is opposite the end of the casing having the inlet opening, an electric motor assembly positioned within the inlet portion of the casing, a plurality of vanes disposed within the inlet portion intermediate the casing and the motor assembly, the vanes contacting the motor assembly so as to provide a heat conduction relationship with the motor assembly and to define a plurality of gas passages intermediate the vanes, a shaft disposed within and coaxial with the axis of the casing, the shaft being rotatably engaged with the motor assembly, a first rotor disposed within the compression portion and attached to the shaft so as to provide a first centrifugal compression stage, the first compression stage being gaseously coupled to the gas passages of the inlet portion, and a second rotor disposed within the compression portion and attached to the shaft so as to provide a second centrifugal compression stage, the second compression stage being gaseously coupled to the first centrifugal compression stage, the second compression stage being intermediate the first centrifugal compression stage and the outlet opening, the second compression stage being gaseously coupled to the outlet opening;

(c) flowing the refrigerant into the inlet portion and around the motor assembly;

(d) conductively transferring the heat dissipated by the motor assembly to the vanes;

(e) convectionally transferring the heat of the vanes to the gaseous refrigerant flowing between the vanes so as to cool the motor assembly, evaporate any liquid in the gaseous refrigerant thereby permitting the evaporator to operate at a zero superheat level, and prevent gaseous refrigerant containing any liquid from entering the first and second compression stages;

(f) suctionally inducing the gaseous refrigerant from the inlet portion into the first centrifugal compressor stage;

(g) centrifugally compressing the gaseous refrigerant within the first compression stage;

(h) exducing the compressed gaseous refrigerant from the first compression stage;

(i) suctionally inducing the compressed gaseous refrigerant exduced from the first compression stage into the second compression stage;

(j) centrifugally compressing the compressed gaseous refrigerant within the second compressor stage; and (k) exducing the doubly centrifugally compressed gaseous refrigerant into the outlet passage of the compression portion.

In a another aspect, the present invention is directed to a multistage centrifugal compressor, comprising a casing having an inlet portion and a compression portion. The inlet portion has an inlet opening gaseously coupled to an evaporator so as to receive a gaseous refrigerant. The inlet and compression portions each have a plurality of gas passages therethrough. The compression portion has an outlet opening that is located at the end of the casing which is opposite the end of the casing having the inlet opening. An electric motor assembly is positioned within the inlet portion of the casing so as to provide a transfer of heat dissipated by the motor assembly to the gaseous refrigerant entering through the inlet opening. The gaseous refrigerant flowing in the inlet opening passes through and about the motor assembly so as to cool the motor assembly. The gaseous refrigerant is heated by the heat dissipated by the motor assembly so as to evaporate any liquid within the gaseous refrigerant thereby permitting the evaporator to operate at a zero superheat level. A shaft is disposed within and is coaxial with the axis of the casing. The shaft is rotatably engaged with the motor assembly. A first rotor is disposed within the compression portion and is attached to the shaft so as to provide a first centrifugal compression stage. The first compression stage is gaseously coupled to the gas passages of the inlet portion. A second rotor is disposed within the compression portion and attached to the shaft so as to provide a second centrifugal compression stage. The second centrifugal compression stage is gaseously coupled to first centrifugal compression stage. The second centrifugal stage is intermediate the first compression stage and the outlet opening, and is gaseously coupled to the outlet opening.

In a further aspect, the present invention is directed to a multistage centrifugal compressor, comprising a casing having an inlet portion and a compression portion. The inlet portion has an inlet opening gaseously coupled to an evaporator so as to receive a gaseous refrigerant. The inlet and compression portions each have a plurality of gas passages therethrough. The compression portion has an outlet opening that is located at the end of the casing which is opposite the end of the casing having the inlet opening. An electrical motor assembly is positioned within the inlet portion of the casing so as to provide a transfer of heat dissipated by the motor assembly to the gaseous refrigerant entering the inlet opening. A plurality of vanes are disposed within the inlet portion intermediate the casing and the motor assembly. The vanes are attached to and radially extend from the inner wall of the casing. The vanes contact the motor assembly so as to provide a heat conduction relationship with the motor assembly and to define a plurality of gas passages intermediate the vanes. A shaft is disposed within and is coaxial with the axis of the casing. The shaft is being rotatably engaged with the motor assembly. A first rotor is disposed within the compression portion and is attached to the shaft so as to provide a first centrifugal compression stage. The first compression stage is gaseously coupled to the gas passages of the inlet portion. A second rotor is disposed within the compression portion and is attached to the shaft so as to provide a second centrifugal compression stage. The second centrifugal compression stage is gaseously coupled to the first centrifugal compression stage. The second centrifugal compression stage is intermediate the first centrifugal compression stage and the outlet opening. The second centrifugal compression stage is gaseously coupled to the outlet opening. The motor assembly and the plurality of vanes cooperate in effecting a transfer of the heat dissipated by the motor assembly to the gaseous refrigerant entering the inlet passage whereby the heat dissipated by the motor assembly is conductively transferred to the vanes and the heat of the vanes is convectionally transferred to the gaseous refrigerant flowing between the vanes so as to cool the motor assembly, evaporate any liquid in the gaseous refrigerant thereby permitting the evaporator to operate at a zero superheat level, and prevent gaseous refrigerant containing liquid from entering the first and second compression stages

BRIEF DESCRIPTION OF THE DRAWINGS

For a fuller understanding of the invention, reference it made to the following description taken in connection with the accompanying drawings, in which.

DESCRIPTION OF THE PREFERRED EMBODIMENTS

Figure 1:
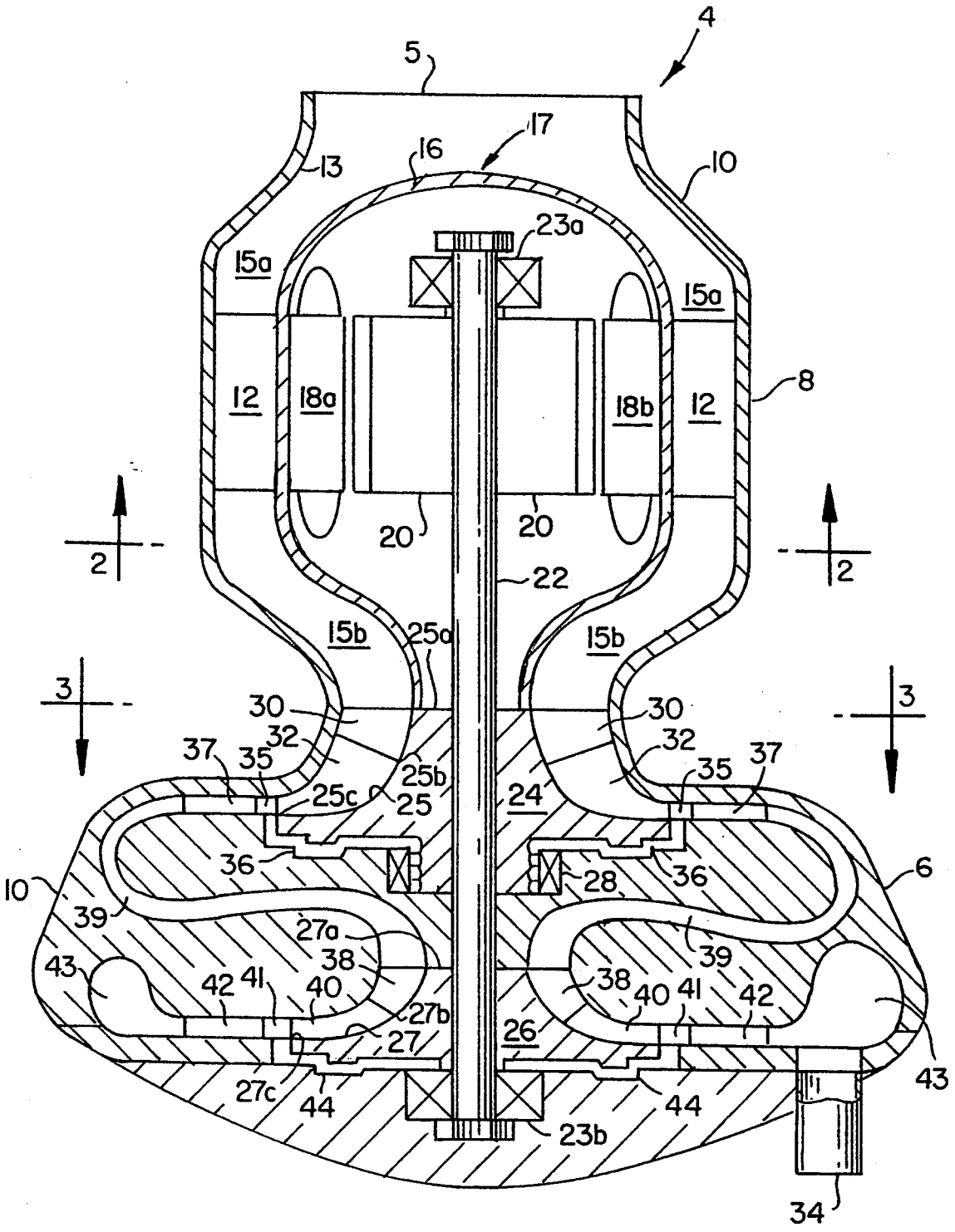
FIG. 1 is a top plan view of the multistage centrifugal compressor of the present invention.

The compressor system of the present invention may be utilized in the air conditioning/refrigeration control system disclosed in commonly assigned U.S. Pat. No. 5,203,179, the disclosure of which is herein incorporated by reference. Referring to FIG. 1, the two-stage centrifugal refrigeration compressor 4 of the present invention is enclosed in gas tight casing 10. In a preferred embodiments, casing 10 is made of aluminum. However, other non-corrosive metals could also be utilized, such as stainless steel. Casing 10 may also be fabricated from plastic. The overall geometric shape of casing 10 is substantially cylindrical. Compressor 4 is comprised of inlet portion 8 and compression portion 6. Inlet passage 5 is gaseously coupled to an evaporator (not shown) and receives a gaseous refrigerant. Electric motor assembly 17 is positioned within inlet portion 8 of compressor 4. Motor assembly 17 is a high frequency, high speed motor such as an induction motor. To obtain the necessary high speeds, such as 60,000 RPM (revolutions per minute), without brushes, high frequency power such as 3750 Hz is supplied to the motor. The high frequency power can be obtained from either a high frequency mechanically driven generator or from a suitable inverter. Since the motor operates in the refrigerant atmosphere, rotating shaft seals are not required. Motor assembly 17 is comprised of housing 16, stator sections 18*a*, 18*b* and rotor 20. Rotor 20 rotates about elongated shaft 22. Shaft 22 is couplingly engaged to bearings 23*a* and 23*b* and extends for substantially the entire length of casing 10. Bearing 23*a* is positioned within motor assembly 17.

Figure 2:
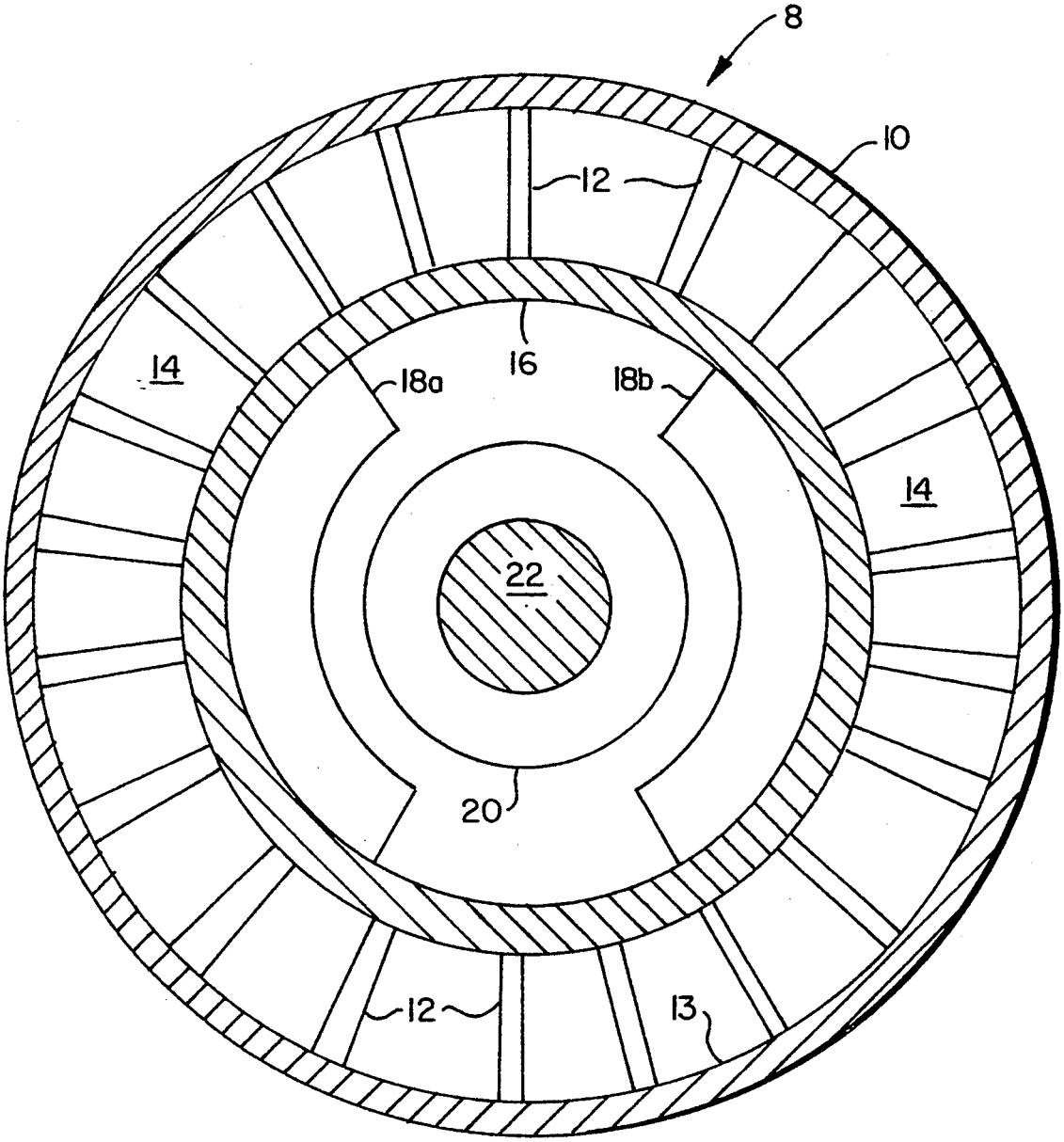
FIG. 2 is a front elevational cross-sectional view taken along line 2—2 of FIG. 1.

Referring to FIG. 2, stationary vanes 12 are interposed between motor assembly housing 16 and inner wall 13 of casing 10. Vanes 12 are attached to and radially extend from inner wall 13. Vanes 12 contact motor assembly housing 16 so as to provide a heat conduction relationship with motor assembly housing 16. In a preferred embodiment, the longitudinal axes of vanes 12 are substantially parallel to the axis of casing 10. Gas passages 14 are formed between vanes 12. Vanes 12 are preferably high conductive fins fabricated from aluminum. Each vane 12 can have a constant thickness or a taper. If tapered aluminum vanes 12 are utilized, the thicker portion of each vane 12 can either contact motor housing 16 or inner wall 13 of casing 10.

One object of the present invention is to provide for simultaneous motor cooling and liquid removal from the gaseous refrigerant which flows into inlet passage 5 from the evaporator. Such liquid removal from the gaseous refrigerant permits the evaporator to operate at zero superheat level. This is accomplished by the transfer of heat from the motor assembly to the incoming gaseous refrigerant flowing into gas passages 14 from gas passages 15*a*. The heat dissipated by motor assembly 17 is transferred to the gaseous refrigerant via a two-step process which comprises the steps of: (1) conduction and (2) convection. Conduction is defined as the transfer of heat between two bodies in direct contact. Referring to FIG. 2, during operation of compressor 4, rotor 20 and stators 18*a*, 18*b* dissipate heat. The heat dissipated by rotor 20 radiates and hence, heats housing 16 and stator section 18*a*, 18*b*. Stator sections 18*a* and 18*b* contact housing 16 so as to provide a heat conduction relationship. The heat dissipated by stators sections 18*a*, 18*b*, and the heat transferred to stators 18*a*, 18*b* from rotor 20, is conductively transferred to housing 16. The heat of housing 16 is conductively transferred to vanes 12 thereby heating vanes 12. The heat of vanes 12 is convectionally transferred to the gaseous refrigerant flowing in passages 14 which are formed by vanes 12. The transfer of the heat of vanes 12 to the gaseous refrigerant achieves three goals:

(1) cooling motor assembly 17, (2) evaporating any liquid in the gaseous refrigerant thereby permitting the evaporator to operate at a zero super heat level, and (3) preventing gaseous refrigerant containing liquid from entering compression portion 6 of compressor 4.

The heat transfer process described above acts as secondary evaporation process which evaporates any residue liquid contained in the gaseous refrigerant that was not completely evaporated within the evaporator. Thus, no liquid-containing gas enters compressor portion 6, and the evaporator need not operate above a zero superheat level. Damage to the compression portion components is also prevented by the secondary evaporation process since these components will not come in contact with any liquid.

Figure 3:
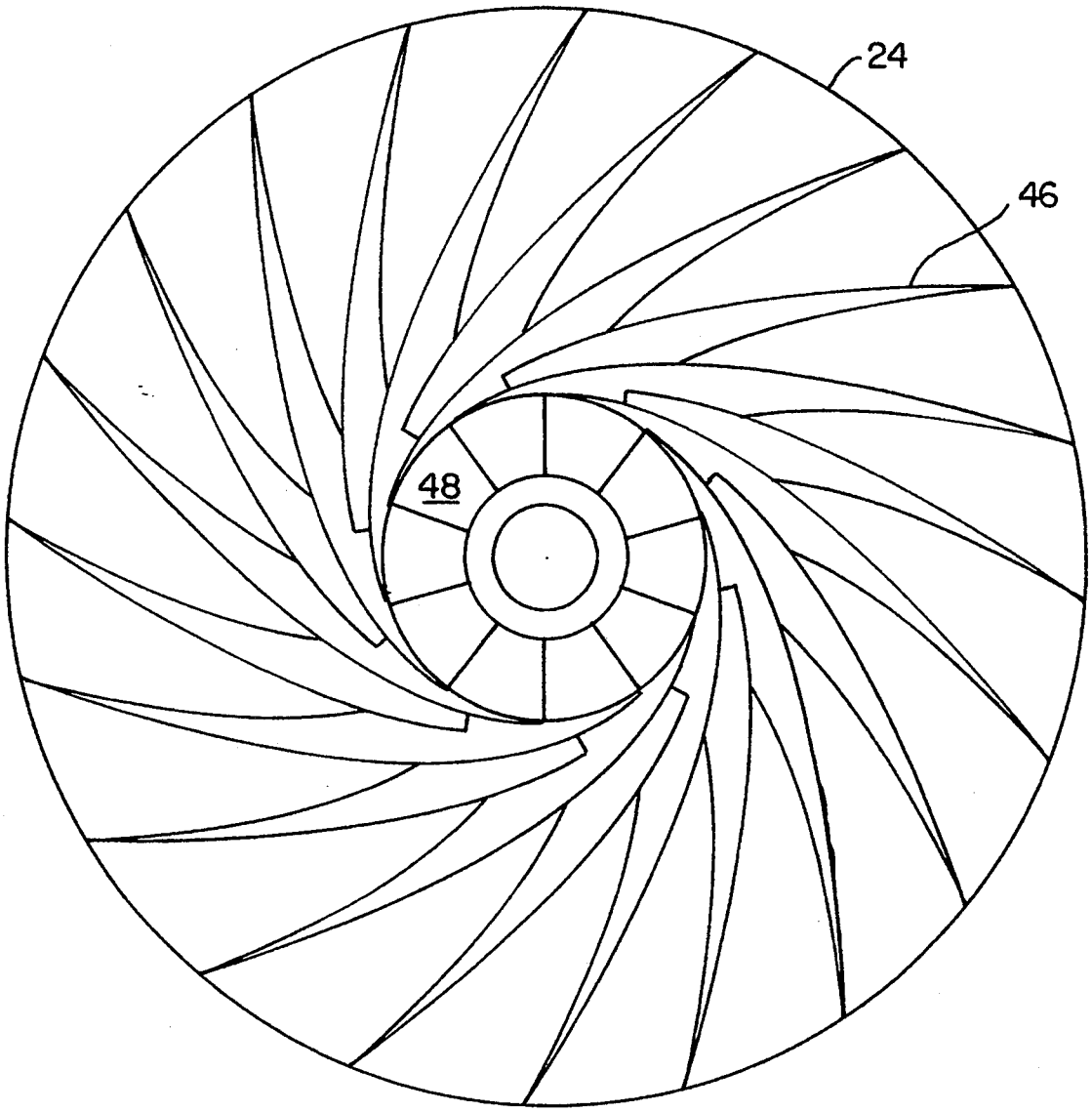
FIG. 3 is a front elevational view taken along line 3—3 of FIG. 1.

Once the gaseous refrigerant passes through gas passages 14, the gas travels through gas passages 15*b*, which are downstream of vanes 12. Referring to FIG. 1, rotor 24 is disposed within compression portion 6 and attached to shaft 22 so as to provide a first centrifugal compression stage. Air gap 36 facilitates rotation of rotor 24 about shaft 22. Rotor 24 is assembled with tight clearance seals 28. Rotor 24 has gas-facing surface 25 thereon which defines a volute inducer airfoil 30 extending over the entire gas-facing surface 25, and exducer airfoil 32, which is partially coextensive with inducer airfoil 30. Referring to FIG. 3, inducer airfoil 30 comprises main blades 46, which extend over the entire gas-facing surface 25 (from edge 25*a* to edge 25*c*). Exducer airfoil 32 comprises splitter blades 48 which extend from midpoint 25*b* of gas facing surface 25 to edge 25*c* and thus, is only partially coextensive with airfoil 30. In a preferred embodiment, the ratio of the number of inducer blades to the number of exducer blades is 2 to 1 (2/1). Inducer airfoil 30 suctionally induces gaseous refrigerant from passage 15*b* into the first compression stage. Exducer airfoil 32 outputs the centrifugally compressed gaseous refrigerant through airgap 35 and over guide vanes 37. Vanes 37 recover static pressure in the flow of gaseous refrigerant leaving the first compression stage and entering gas passage 39.

Rotor 26 is disposed within compression portion 6 and attached to shaft 22 so as to provide a second centrifugal compression stage. Air gap 44 facilitates rotation of rotor 26 about shaft 22. Rotor 26 has gas-facing surface 27 thereon which defines a volute inducer airfoil 38 extending over the entire gas-facing surface 27 (from edge 27*a* to edge 27*c*), and a volute exducer airfoil 40 which extends from gas-facing surface midpoint 27*b* to edge 27*c*. Thus, airfoil 40 is only partially coextensive with inducer airfoil 38. Although FIG. 3 is a front elevation view of rotor 24, FIG. 3 also represents a front elevational view of rotor 26. However, the diameter of rotor 26 is less than that of rotor 24. Similar to rotor 24, inducer airfoil 38 comprises a set of main blades and exducer airfoil 40 comprises a set of splitter blades. The ratio of the number of main blades to splitter blades is 2 to 2 (2/1). Inducer airfoil 38 suctionally induces gaseous refrigerant from passage 39 into the second compression stage. Exducer airfoil 40 outputs the doubly centrifugally compressed gaseous refrigerant through airgap 41 and guide vanes 42. Vanes 42 recover static pressure in the flow of gaseous refrigerant leaving the second compression stage and entering gas passage 43. The doubly compressed gaseous refrigerant exits gas passage 43 via exit nozzle 34.

Figure 4:
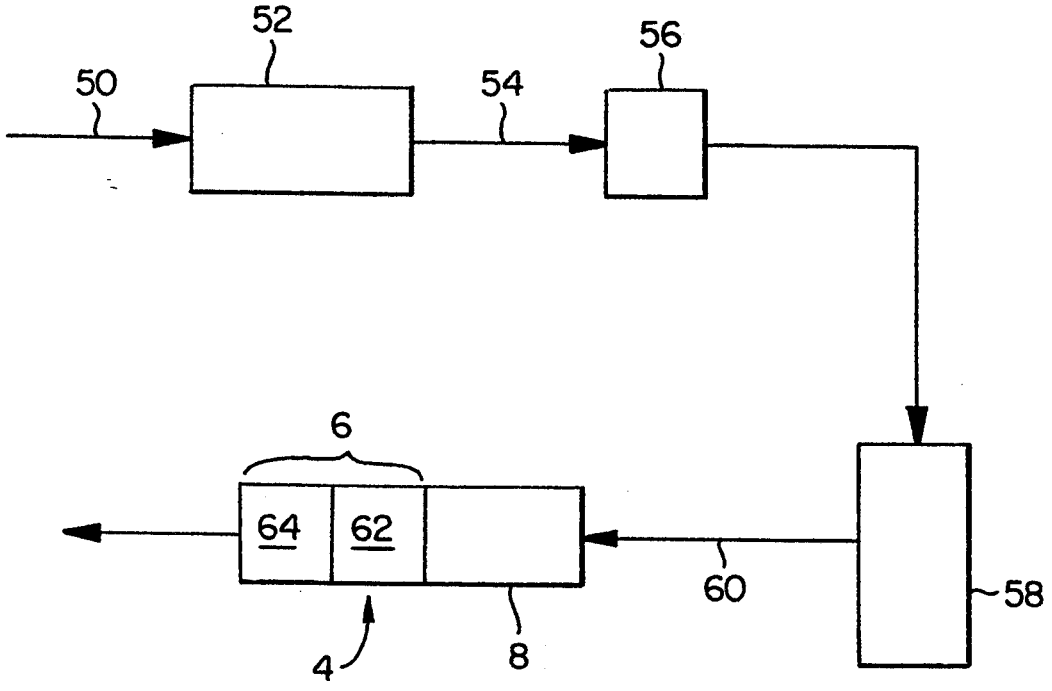
FIG. 4 is a block diagram of a refrigerant system utilizing the compression system of the present invention.

FIG. 4 is a general block diagram of an air conditioning/refrigeration system that utilizes the compressor of the present invention. Refrigerant passes through line 50 to condenser 52 where it is cooled and liquefied. The now cooled and liquefied refrigerant passes through line 54 to variable expansion valve 56. Valve 56 controls the refrigerant flow rate to maintain a desired superheat in the refrigerant when it exits evaporator 58 in a gaseous state. The now gaseous refrigerant exits evaporator 58 through line 60 and passes into compressor 4 where it first enters inlet portion 8. Through the aforementioned processes of conduction and convection, any liquid contained in the gaseous refrigerant is removed before the gaseous refrigerant enters the compression portion 6 of compressor 4. This removal of any liquid from the gaseous refrigerant acts as a secondary evaporation process. Hence, valve 56 may be set so as to allow evaporator 58 to operate at a zero superheat level. The now liquid-free gaseous refrigerant then passes into compression portion 6, which is comprised of sequential centrifugal compression stages 62 and 64.

Thus, the objects set forth above are achieved by compressor 4 which:

(a) utilizes two (2) sequentially arranged centrifugal compression stages positioned within casing 10 thereby eliminating the need for external transfer and bypass tubes or piping;

(b) is light in weight and small in size due to the utilization of a lightweight, high frequency and high speed motor assembly 17;

(c) provides for motor cooling without extracting liquid refrigerant from the condenser;

(d) removes any liquid from the gaseous refrigerant flowing in inlet portion 8 thereby preventing any liquid from entering compression portion 6 and permitting evaporator 58 to operate at a zero superheat level; and (e) has a geometric design and a left side/right side drive capability which facilitates integration of compressor 4 into automobile systems, and which allows it to be located on or substantially adjacent the vehicle centerline.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

While the invention has been illustrated and described in what are considered to be the most practical and preferred embodiments, it will be recognized that many variations are possible and come within the scope thereof, the appended claims therefore being entitled to a full range of equivalents.

Thus, having described the invention, what is claimed is:

1. A method of operating a refrigeration system, comprising the steps of:

(a) providing a refrigeration system comprising a condenser for cooling and liquefying refrigerant, an evaporator and a valve connected between the condensor and the evaporator for controlling the refrigerant flow from the condensor to the evaporator so as to maintain the operation of the evaporator at a normal zero superheat level;

(b) providing a centrifugal compressor, said compressor comprising a gas tight casing having an inlet portion and a compression portion, said inlet portion having an inlet opening gaseously coupled to said evaporator so as to receive a gaseous refrigerant, said inlet and compression portions each having a plurality of gas passages therethrough, said gas passages in said inlet portion being substantially parallel to the axis of said casing, said compression portion having an outlet opening that is located at the end of said casing which is opposite the end of said casing having said inlet opening, an electric motor assembly positioned within said inlet portion of said casing, a shaft disposed within and coaxial with the axis of said casing, said shaft being rotatably engaged with said motor assembly, at least one (1) centrifugal compression stage gaseously coupled to said inlet portion and to said outlet opening, said compression stage being drivingly engaged with said shaft and intermediate said inlet portion and said outlet opening;

(c) axially flowing the refrigerant gas into said inlet portion and around said motor assembly substantially parallel to the axis of said casing;

(d) convectively transferring the heat dissipated by said motor assembly to the gaseous refrigerant flowing in said inlet portion so as to cool the motor assembly, evaporate any liquid in the gaseous refrigerant thereby permitting the evaporator to operate at a zero superheat level, and prevent gaseous refrigerant containing liquid from entering said compression stage;

(e) suctionally inducing the gaseous refrigerant from said inlet portion into said centrifugal compressor stage;

(f) centrifugally compressing the gaseous refrigerant within said compression stage; and (g) exducing the compressed gaseous refrigerant from said compression stage into said outlet passage.

2. The method of claim 1 further comprising a plurality of vanes disposed within said inlet portion intermediate said casing and said motor assembly, said vanes contacting said motor assembly so as to provide a heat conduction relationship with said motor assembly and to define a plurality of gas passages intermediate said vanes.

3. The method of claim 2 wherein step (d) further comprises the steps of:

(a) conductively transferring the heat dissipated by said motor assembly to said vanes; and (b) convectionally transferring the heat of said vanes to the gaseous refrigerant flowing between said vanes.

4. The method of claim 1 wherein said gas passages of said inlet portion and said compression stage are gaseously coupled directly to one another at a point within said casing without the utilization of transfer tubes external to said casing.

5. The method of claim 1 wherein said casing has a substantially cylindrical shape.

6. The method of claim 1 further including a pair of bearings, each of which being couplingly engaged with a corresponding end of said shaft, said bearings being arranged in said casing in a manner such that said compression stage and said motor assembly are intermediate said bearings.

7. The method claim 1 wherein the direction of the flow of gaseous refrigerant entering said inlet opening and exiting said outlet opening is substantially parallel to the axis of said casing.

8. The method of claim 1 wherein said compression stage is comprised of a rotor disposed within said compression portion and attached to said shaft so as to provide a centrifugal compression stage.

9. A method of operating a refrigeration system, comprising the steps of: (a) providing a refrigeration system comprising a condenser for cooling and liquefying refrigerant, an evaporator and a valve connected between the condensor and the evaporator for controlling the refrigerant flow from the condensor to the evaporator so as to maintain the operation of the evaporator at a nominal zero superheat level;

(b) providing a centrifugal compressor, said compressor comprising a gas tight casing having an inlet portion and a compression portion, said inlet portion having an inlet opening gaseously coupled to the evaporator so as to receive a gaseous refrigerant, said inlet and compression portions each having a plurality of gas passages therethrough, said compression portion having an outlet opening that is located at the end of said casing which is opposite the end of said casing having said inlet opening, the direction of flow of gaseous refrigerant entering said inlet opening, and exiting said outlet opening being substantially parallel to the axis of said casing, an electric motor assembly positioned within said inlet portion of said casing, a plurality of vanes disposed within said inlet portion intermediate said casing and said motor assembly, said vanes contacting said motor assembly so as to provide a heat conduction relationship with said motor assembly and to define a plurality of gas passages intermediate said vanes, the longitudinal axes of said vanes being substantially parallel to the axis of said casing, a shaft disposed within and coaxial with the axis of said casing, said shaft being rotatably engaged with said motor assembly, a first rotor disposed within said compression portion and attached to said shaft so as to provide a first centrifugal compression stage, said first compression stage being gaseously coupled to said gas passages of said inlet portion, and a second rotor disposed within said compression portion and attached to said shaft so as to provide a second centrifugal compression stage, said second compression stage being gaseously coupled to said first centrifugal compression stage, said second compression stage being intermediate said first centrifugal stage and said outlet opening, said second compression stage being gaseously coupled to said outlet opening;

(c) flowing the refrigerant into said inlet portion and around said motor assembly;

(d) conductively transferring the heat dissipated by said motor assembly to said vanes;

(e) convectionally transferring the heat of said vanes to the gaseous refrigerant flowing between said vanes so as to cool the motor assembly, evaporate any liquid in the gaseous refrigerant thereby permitting the evaporator to operate at a zero superheat level, and prevent gaseous refrigerant containing liquid from entering said first and second compression stages;

(f) suctionally inducing the gaseous refrigerant from said inlet portion into said first centrifugal compressor stage;

(g) centrifugally compressing the gaseous refrigerant within said first compression stage;

(h) exducing the compressed gaseous refrigerant from said first compression stage;

(i) suctionally inducing the compressed gaseous refrigerant exduced from said first compression stage into said second compression stage;

(j) centrifugally compressing the compressed gaseous refrigerant within said second compressor stage; and (k) exducing the doubly centrifugally compressed gaseous refrigerant into said outlet passage of said compression portion.

10. A multistage centrifugal compressor for use in a refrigeration system comprising a condensor for cooling and liquefying refrigerant, an evaporator and a valve connected between the condensor and the evaporator for controlling the refrigerant flow from the condensor to the evaporator so as to maintain the operation of the evaporator at a nominal zero superheat level, comprising:

a casing having an inlet portion and a compression portion, said inlet portion having an inlet opening gaseously coupled to the evaporator so as to receive a gaseous refrigerant, said inlet and compression portions each having a plurality of gas passages therethrough, said gas passages in said inlet portion being substantially parallel to the axis of said casing, said compression portion having an outlet opening that is located at the end of said casing which is opposite the end of said casing having said inlet opening;

an electric motor assembly positioned within said inlet portion of said casing so as to provide a transfer of heat dissipated by the motor assembly to the gaseous refrigerant entering through said inlet opening whereby the gaseous refrigerant flowing in said inlet opening passes through and about said motor assembly substantially parallel to the axis of said casing so as to cool said motor assembly, the gaseous refrigerant being convectively heated the heat dissipated by said motor assembly so as to evaporate any liquid remaining within the gaseous refrigerant thereby permitting the evaporator to operate at a nominal zero superheat level;

a shaft disposed within and coaxial with the axis of said casing, said shaft being rotatably engaged with said motor assembly;

a first rotor disposed within said compression portion and attached to said shaft so as to provide a first centrifugal compression stage, said first compression stage being gaseously coupled to said gas passages of said inlet portion; and a second rotor disposed within said compression portion and attached to said shaft so as to provide a second centrifugal compression stage, said second centrifugal compression stage being gaseously coupled to said first centrifugal compression stage, said second centrifugal stage being intermediate said first centrifugal compression stage and said outlet opening, said second centrifugal compression stage being gaseously coupled to said outlet opening.

11. The multistage centrifugal compressor of claim 1 wherein said gas passages of said inlet portion and said first compression stage are gaseously coupled directly to one another at a point within said casing without the utilization of transfer tubes external to said casing, and said first compression stage and said second compression stage are gaseously coupled directly to one another at a point within said casing without the utilization of transfer tubes external to said casing.

12. The multistage compressor of claim 10 wherein said casing has a substantially cylindrical shape.

13. The multistage compressor of claim 10 further including a pair of bearings, each of which being couplingly engaged with a corresponding end of said shaft, said bearings being arranged in said casing in a manner such that said rotors and said motor assembly are intermediate said bearings.

14. The multistage compressor of claim 10 wherein the direction of the flow of gaseous refrigerant entering said inlet opening and exiting said outlet opening is substantially parallel to the axis of said casing.

15. The multistage centrifugal compressor of claim 14 wherein said gas passages are axisymmetrically formed within said casing.

16. The multistage compressor of claim 10 further including a plurality of vanes disposed within said inlet portion intermediate said casing and said motor assembly, said vanes being attached to and radially extending from the inner wall of said casing, said vanes contacting said motor assembly so as to provide a heat conduction relationship with said motor assembly and to define a plurality of gas passages intermediate said vanes, said gaseous refrigerant circulating within said gas passages intermediate said vanes being heated by the heat transfer processes of conduction and convection whereby the heat dissipated from said motor assembly is conductively transferred to said vanes and the heat of said vanes is convectionally transferred to the gaseous refrigerant circulating between said vanes so as to evaporate any liquid in the gaseous refrigerant thereby permitting the evaporator to operate at a zero superheat level.

17. The multistage centrifugal compressor of claim 16 wherein the longitudinal axes of said vanes are substantially parallel to the axis of said casing.

18. The multistage centrifugal compressor of claim 10 wherein said first and second rotors each have a gas-facing surface.

19. The multistage centrifugal compressor of claim 18 wherein said gas facing surface of said first and second rotors define a volute inducer airfoil extending over said gas-facing surface and an exducer airfoil partially coextensive with said inducer foil, whereby said inducer airfoil of said first rotor suctionally induces the gaseous refrigerant into said first compression stage and said exducer airfoil of said first rotor outputs the centrifugally compressed gaseous refrigerant into said second compression stage, and said inducer airfoil of said second rotor suctionally induces the centrifugally compressed gaseous refrigerant outputted from said first compression stage into said second compression stage, and said inducer airfoil of said second compression stage outputs the doubly centrifugally compressed gaseous refrigerant into said outlet passage of said compression portion.

20. The multistage centrifugal compressor of claim 19 further including a first plurality of guide vanes intermediate said exducer airfoil of said first rotor and said second centrifugal compression stage for recovering static pressure in the flow of gaseous refrigerant leaving said first compression stage and entering the said second compression stage.

21. The multistage centrifugal compressor of claim 20 further including a second plurality of guide vanes intermediate said exducer of said second compression stage and said outlet passage of said compression portion for recovering static pressure in the flow of gaseous refrigerant leaving said second compression stage and entering said outlet passage.

22. A multistage centrifugal compressor for use in a refrigeration system comprising a condensor for cooling and liquefying refrigerant, an evaporator and a valve connected between the condensor and the evaporator for controlling the refrigerant flow from the condensor to the evaporator so as to maintain the operation of the evaporator at a nominal zero superheat level, comprising:

a casing having an inlet portion and a compression portion, said inlet portion having an inlet opening gaseously coupled to an evaporator so as to receive a gaseous refrigerant, said inlet and compression portions each having a plurality of gas passages therethrough, said compression portion having an outlet opening that is located at the end of said casing which is opposite the end of said casing having said inlet opening, the direction of the flow of gaseous refrigerant entering said inlet opening and exiting said outlet opening being substantially parallel to the axis of said casing;

an electrical motor assembly positioned within said inlet portion of said casing so as to provide a transfer of heat dissipated by said motor assembly to the gaseous refrigerant entering said inlet opening;

a plurality of vanes disposed within said inlet portion intermediate said casing and said motor assembly, said vanes being attached to and radially extending from the inner wall of said casing, said vanes contacting said motor assembly so as to provide a heat conduction relationship with said motor assembly and to define a plurality of gas passages intermediate said vanes; the longitudinal axes of said vanes being substantially parallel to the axis of said casing;

a shaft disposed within and coaxial with the axis of said casing, said shaft being rotatably engaged with said motor assembly;

a first rotor disposed within said compression portion and attached to said shaft so as to provide a first centrifugal compression stage, said first compression stage being gaseously coupled to said gas passages of said inlet portion; and a second rotor disposed within said compression portion and attached to said shaft so as to provide a second centrifugal compression stage, said second centrifugal compression stage being gaseously coupled to said first centrifugal compression stage, said second centrifugal compression stage being intermediate said first centrifugal compression stage and said outlet opening, said second centrifugal compression stage being gaseously coupled to said outlet opening;

said motor assembly and said plurality of vanes cooperating in effecting a transfer of the heat dissipated from said motor assembly to the gaseous refrigerant entering said inlet passage whereby the heat dissipated by said motor assembly is conductively transferred to said vanes and the heat of said vanes is convectionally transferred to the gaseous refrigerant flowing between said vanes so as to cool said motor assembly, evaporate any liquid in the gaseous refrigerant thereby permitting the evaporator to operate at a nominal zero superheat level, and prevent gaseous refrigerant containing liquid molecules from entering said first and second compression stages.

23. The multistage centrifugal compressor of claim 22 wherein said gas passages of said inlet portion and said first compression stage are directly gaseously coupled to one another at a point inside said casing without the utilization of transfer tubes external to said casing, and said first and second compression stages are directly gaseously coupled to one another at a point inside said casing without the utilization of transfer tubes external to said casing.

24. The multistage compressor of claim 22 wherein said gas passages of said inlet and compression portions are axisymmetrical.

25. The multistage compressor of claim 22 further including a pair of bearings, each of which being coupling engaged with a corresponding end of said shaft, said bearing arranged in said casing in a manner such that said rotors and said motor assembly are intermediate said bearings.

26. The multistage compressor of claim 22 wherein the direction of the flow of gaseous refrigerant entering said inlet opening and exiting said outlet opening is substantially parallel to the axis of said casing.

27. The multistage centrifugal compressor of claim 22 wherein said casing has a substantially cylindrical shape.

28. The multistage centrifugal compressor of claim 22 wherein said first and second rotors each have a gas-facing surface.

29. The multistage centrifugal compressor of claim 28 wherein said gas facing surface of said first and second rotors define a volute inducer airfoil extending over said gas-facing surface, and an exducer airfoil partially coextensive with said inducer foil, whereby said inducer airfoil of said first rotor suctionally induces the refrigerant gas into said first compression stage and said exducer airfoil of said first rotor outputs the centrifugally compressed gaseous refrigerant into said second compression stage, and said inducer airfoil of said second rotor suctionally induces the centrifugally compressed gaseous refrigerant outputted from said first compression stage into said second compression stage, and said exducer airfoil of said second compression stage outputs the doubly centrifugally compressed gaseous refrigerant into said outlet passage of said compression portion.

* * * * *

UNITED STATES PATENT AND TRADEMARK OFFICE

CERTIFICATE OF CORRECTION

PATENT NO. : 5,363,674

DATED : November 15, 1994

INVENTOR(S) : James W. Powell

It is certified that error appears in the above-identified patent and that said Letters Patent is hereby corrected as shown below:

Column 9, Line 11, Claim 1: "normal" should read - - nominal - -.

Signed and Sealed this

Twenty-eight Day of February, 1995

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,363,674

DATED : November 15, 1994

INVENTOR(S) : James W. Powell

It is certified that error appears in the above-identified patent and that said Letters Patent is hereby corrected as shown below:

Column 12, line 6, Claim 11: "1" should be - - 10 - -.

Signed and Sealed this

Twelfth Day of September, 1995

*Attest:*

*Attesting Officer*

BRUCE LEHMAN

*Commissioner of Patents and Trademarks*